US006405378B1

(12) United States Patent
Garner

(10) Patent No.: US 6,405,378 B1
(45) Date of Patent: Jun. 18, 2002

(54) PASSENGER ASSISTANCE ROADSIDE KIT

(76) Inventor: Tracy A. Garner, 59 Haddock Dr., Sewell, NJ (US) 08080

( * ) Notice: Subject to any disclaimer, the term of this patent is extended or adjusted under 35 U.S.C. 154(b) by 0 days.

(21) Appl. No.: 09/714,002

(22) Filed: Nov. 16, 2000

(51) Int. Cl.[7] ..... A41D 1/04
(52) U.S. Cl. ..... 2/102; 383/4
(58) Field of Search ..... 2/102, 69, 93, 2/94, 108, 72, 85, 86, 89, 247, 253; 224/575–577; 383/4

(56) References Cited

U.S. PATENT DOCUMENTS 3,105,241 A * 10/1963 Allen ..... 2/94
3,848,267 A * 11/1974 De Spain ..... 2/94
4,369,526 A 1/1983 Cultts
4,483,469 A * 11/1984 Arisland ..... 224/151
4,637,075 A 1/1987 Ingrisano et al.
4,637,076 A * 1/1987 Tartt et al. ..... 2/102
5,014,359 A * 5/1991 Hanson ..... 2/94
5,211,321 A 5/1993 Rodriguez
5,278,998 A * 1/1994 Book ..... 2/102
5,361,412 A * 11/1994 Perry ..... 2/69
5,490,619 A * 2/1996 Boyar ..... 224/153
5,787,504 A * 8/1998 Wu ..... 2/93
5,860,164 A * 1/1999 Johnson ..... 2/94

* cited by examiner

*Primary Examiner*—Gloria M. Hale
*Assistant Examiner*—Tejash Patel
(74) *Attorney, Agent, or Firm*—Susan B. Evans

(57) ABSTRACT

Disclosed herein is a roadside emergency vest that is convertible to a storage case. The roadside emergency vest also referred to as a passenger assistance roadside kit (PARK™) is a multifunctional safety product. The invention is a carrying case for storage of automobile emergency equipment supplies which converts into a highly visible safety vest. The breast panels and upper back panels of the vest may be conveniently stored in a storage compartment located on the inside of the back panel of the emergency vest. This invention is especially designed to help reduce the dangers involved with roadside emergencies.

17 Claims, 6 Drawing Sheets

PASSENGER ASSISTANCE ROADSIDE KIT

The present invention is related to a roadside emergency vest that is convertible to a storage case which serves as a primary element of a passenger assistance roadside kit.

BACKGROUND OF THE INVENTION

In today's society, more people are driving more and are subject to roadside emergencies. The passenger assistance roadside kit (hereinafter "PARK system™") was invented to help reduce the dangers involved with these roadside emergencies. Due to a lack of preparedness during an untimely vehicle malfunction, many drivers often experience the need for expensive roadside assistance.

For instance while on a trip to Anywhere, USA, a driver realizes that the road they are traveling on has a myriad of potholes, nails, and broken glass. The net result, a flat tire! If they are fortunate, they are able to maneuver their vehicle to the side of the road. However, they are only a few feet from the path of hurriedly passing vehicles on this dark road. As they sit in their car the thunderstorm begins. With no cellular phone to activate any roadside assistance, the question begs, what will they do? Even for those brave enough to face the challenge and dangers of the passing vehicles, here is the typical action taken: After expressing their frustrated disgust, the individual exits their vehicle and proceeds to walk to the rear of their car to open the trunk. In the midst of the wind caused by the zooming vehicles, panic strikes because it has been discovered that they need to be a rocket scientist not only to locate the tools necessary to change their flat tire, but also to use them once they find them. Nevertheless, frustrated, soaked, and probably by this time late, the individual proceeds to the deflated tire to assume the challenge of changing the tire. Then the most common problem in this type of roadside scenario is realized. The only illumination that is available for the protection of the individual and the vehicle is the secondary light given by the disabled vehicle and the fleeting light produced by the passing vehicles. Simply stated, the individual does not have the adequate materials or lighting to change the tire in a safe and efficient manner! In an instant, both parties (passengers of the disabled vehicle and passing motorists) fall victim to the element of surprise and are caught unawares of the often deadly dangers presented by this common roadside hazard.

The PARK System™ addresses this hazard. It combines the use of a roadside emergency vest with many safety products specifically tailored to address driver self-sufficiency and practical roadside safety. This invention reduces the dangers involved with roadside repairs.

Prior to the present invention, several utility vests existed. U.S. Pat. Nos. 4,369,526, 4,637,075, 4,637,076, 4,669,127, 5,211,321 and 5,361,412 disclose utility vests generally. None of this prior art discloses the instant invention.

SUMMARY OF THE INVENTION

The present invention is directed to a roadside emergency vest having rear, and left and right front portions that is convertible from a roadside emergency vest to a storage case, said vest comprising a neck opening, a waist opening, two arm openings, left and right breast panels forming the front portion, a back panel having an upper section and a lower section, an inside and an outside forming the rear portion, a front closure means for joining the left and right breast panels together at the front, a side closure means for joining the left and right breast panels with the back panel, a storage compartment located on the inside of the back panel lower section that is constructed integrally of material with back panel and having left and right side walls, a bottom wall, and a front wall, and a closure means at the top of storage compartment for closing the storage compartment, whereby:

i) when the vest is used as a vest, the left and right breast panels are joined to the back panel with the side closure means and the left and right breast panels are joined together with front closure means or are left open and ii) when the vest is converted into a storage case, the left and right breast panels and upper back section are stored in the storage compartment.

The present invention is further directed to a roadside emergency kit that is a roadside emergency vest which converts to a storage case with emergency equipment stored therein and creating an integral part thereof comprising a convertible vest having a neck opening, a waist opening, two arm openings, left and right breast panels forming the front portion, a back panel having an upper section and a lower section, an inside and an outside forming the rear portion, a front closure means for joining the left and right breast panels together at the front, a side closure means for joining the left and right breast panels with the back panel, a storage compartment located on the inside of the back panel lower section that is constructed integrally of material with back panel and having left and right side walls, a bottom wall, and a front wall, and a closure means at the top of storage compartment for closing the storage compartment, whereby:

i) when the vest is used as a vest, the left and right breast panels are joined to the back panel with the side closure means and the left and right breast panels are joined together with front closure means or are left open, and ii) when the vest is converted into a storage case, the left and right breast panels and upper back section are stored in the storage compartment; and further comprising Emergency equipment stored in the storage compartment of the vest selected from the group consisting of flashlight, first aid kit, flares, gloves, cellular phone, screwdrivers, wrenches, tire gauges, tire inflation products, strobe lights, siphon hoses, batteries, jumper cables and rain gear.

DETAILED DESCRIPTION OF THE INVENTION

Disclosed herein is a roadside emergency vest 10 that is convertible to a storage case. The roadside emergency vest 10, also referred to as a passenger assistance roadside kit (PARK™), is a multifunctional safety product. The invention serves as a carrying case for storage of emergency equipment. This storage case, also referred to as a carrying case or storage compartment, herein, converts into a highly visible safety vest.

Referring now specifically to the drawings, the numeral 10 generally designates a roadside emergency vest which has the novel and improved features of this invention incorporated therein. FIGS. 1–8 collectively illustrate the components of the present invention.

Figure 1:
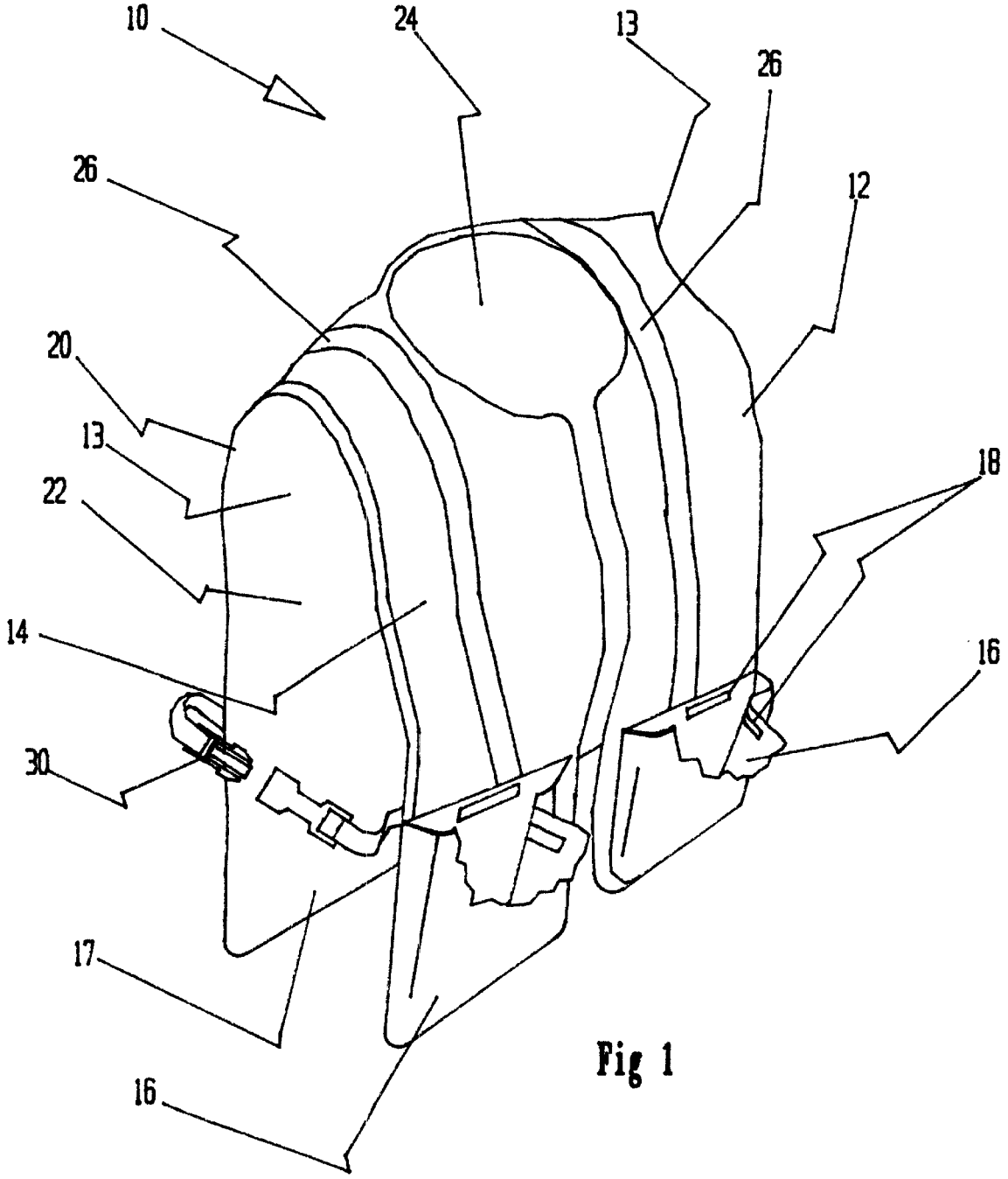
FIG. 1 is a side view of the roadside emergency vest with a cut away view of the front exterior pockets.

FIG. 1 illustrates the front exterior and back interior portions 22 of the vest 10 including a neck opening 24, a waist opening 17, two arm openings 13, left and right breast panels 12, 14 forming the front portion, a front closure means 15 for joining the left and right breast panels together at the front, a side closure means 30 for joining the left and right breast panels 12, 14 with the back panel 20, reflective strips 26, and pockets 16 optionally placed on the front and rear, interior and exterior of the emergency vest 10 fitted specifically to accommodate a wide range of emergency equipment. A plurality of pockets 16 are strategically placed on the interior and exterior of the front and back of the subject vest 10. The pockets 16 are sized to fit the emergency equipment that is stored therein and placed on the vest to accommodate easy access to the user as well as consider the size and weight of the emergency equipment.

Emergency equipment may include but not be limited to flashlight, first aid kit, flares, gloves cellular phone, screwdrivers, wrenches, tire gauges, tire inflation products, strobe lights, siphon hoses, batteries, jumper cables and rain gear. Emergency equipment items are well known in the art and available from a number of manufacturers. The emergency vest 10, also referred to herein as vest, of the present invention may be composed of any number of materials well known in the art selected from the group consisting of cotton, nylon, synthetic polyester, rip stop, koskin, rubber or rubber like, and pack cloth. Preferably cotton or nylon. The vest 10 is preferably made of a bright color, more preferably yellow, red or orange. The vest 10 of the present invention is further illuminated with materials selected from the group consisting of reflective materials 26 and strobe lights, preferably reflective materials 26. This FIG. 1 further illustrates that the garment has one or more pockets 16 on the left and right breast panels 12, 14 constructed to receive automobile safety equipment. Further illustrated are the closure means for pockets 18 on the left and right breast panels 12, 14 selected from the group consisting of zipper, Velcro™, snaps, flaps and buckles. The pockets 16 on the left and right breast panels 12, 14 are optionally detachably connected. The side closure means 30 for joining the left and right breast panels 12, 14 to the back panel 20 is selected from the group consisting of a zipper, Velcro, ties, buttons, straps, belts, snaps, hooks, ladder locks and buckles. These closure means 30 are well known in the art and are available through a number of different manufacturers.

Figure 2:
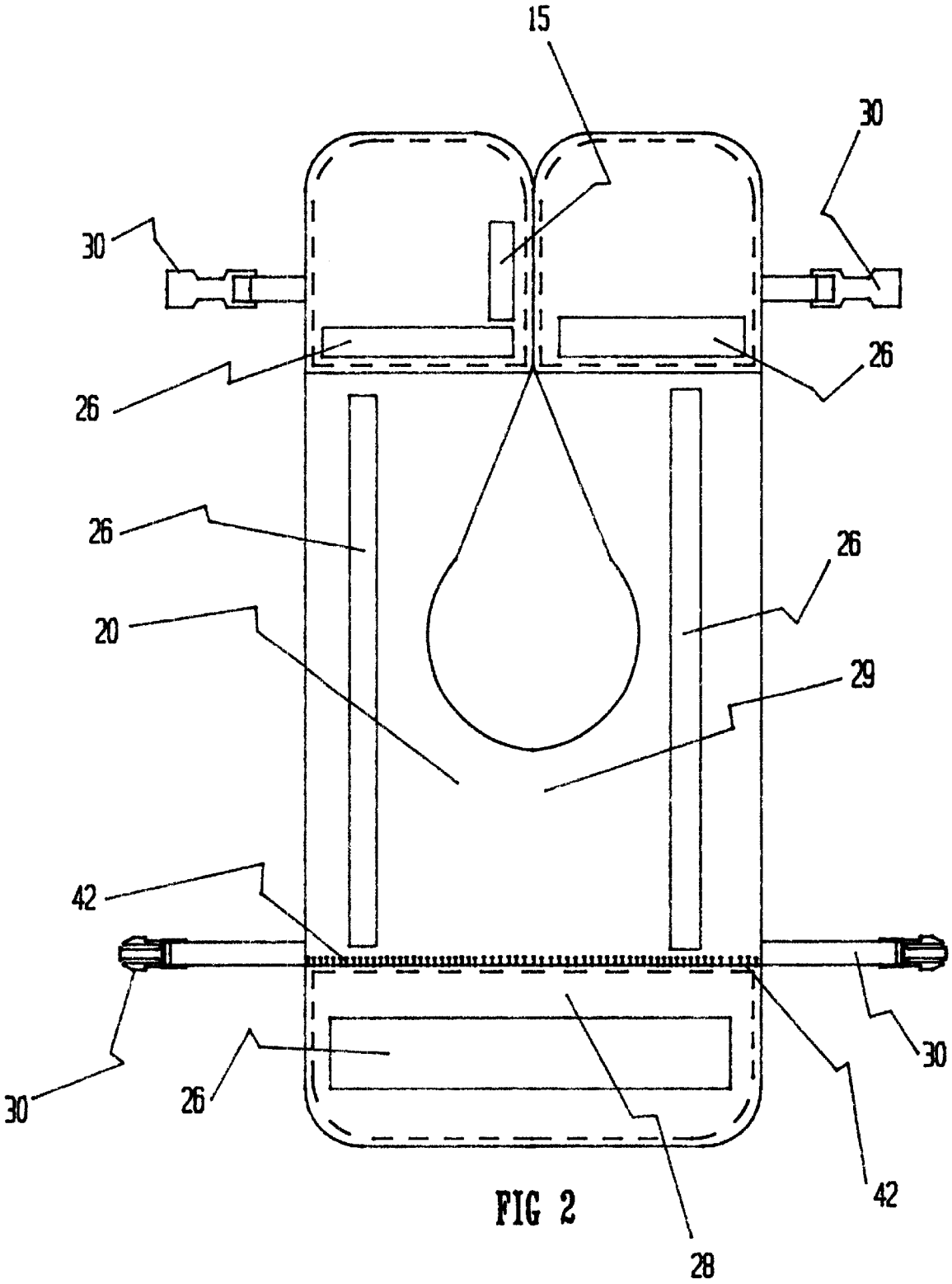
FIG. 2 is a perspective view of the exterior of the roadside emergency vest.

FIG. 2 illustrates a perspective view of the exterior of the roadside emergency vest 10. Showing the contiguous front and rear portions. The front and rear portions have a variety of reflective strips 26 placed in various positions. The back panel 20 has an upper section 29 and a lower section 28, an interior 22 and an exterior forming the rear portion, a front closure means 15 for joining the left and right breast panels 12, 14 together at the front, a side closure means 30 for joining the left and right breast panels 12, 14 with the back panel 20, a closure means 42, 43 for closing a storage compartment 40 located on the inside of the back panel lower section 28 and receives the folded elements of the vest 10 when in a closed position. The lower section of the exterior back panel 28 forms the exterior wall of the storage compartment 40.

Figure 3:
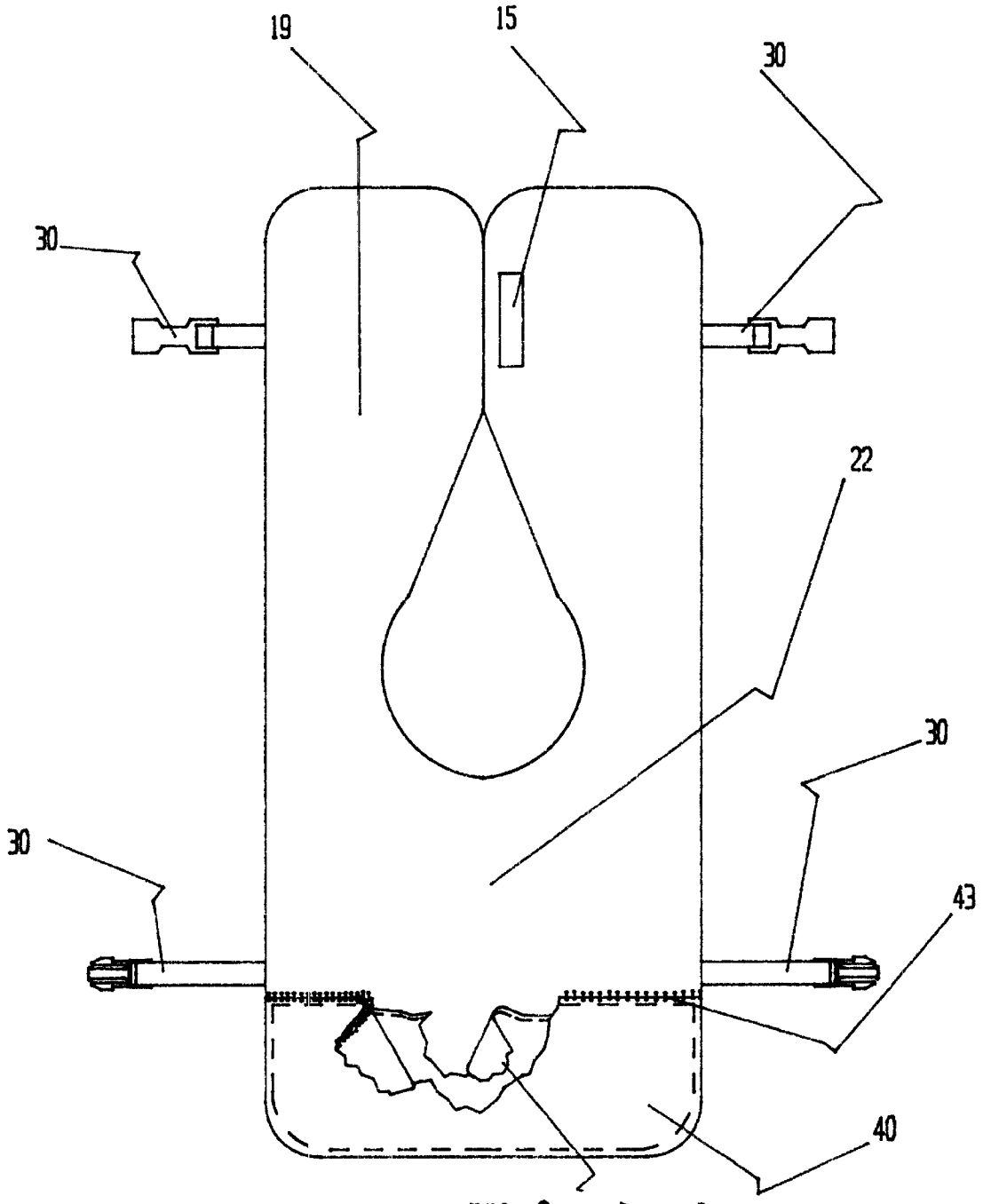
FIG. 3 is a perspective view of the interior of the roadside emergency vest with a cut away view of the storage compartment and separator flap.

FIG. 3 is a perspective view of the interior of the roadside emergency vest 10. It illustrates a storage compartment 40 located on the inside of the back panel lower section 28 that is constructed integrally of material with back panel 20 and having left and right side walls, a bottom wall, and a front wall, and a closure means 42, 43 at the top of storage compartment 40 for closing the storage compartment 40. It is structured so that when the vest 10 is used as a vest 10, the left and right breast panels 12, 14 are joined to the back panel 20 with the side closure means 30 and the left and right breast panels 12, 14 are joined together with front closure means 15 or are left open and when the vest 10 is converted into a storage case, the left and right breast panels 12, 14 and upper back section 29 are stored in the storage compartment 40. It further illustrates an interior separator flap 46 in the storage compartment 40 which provides additional segregated storage space.

Figure 4:
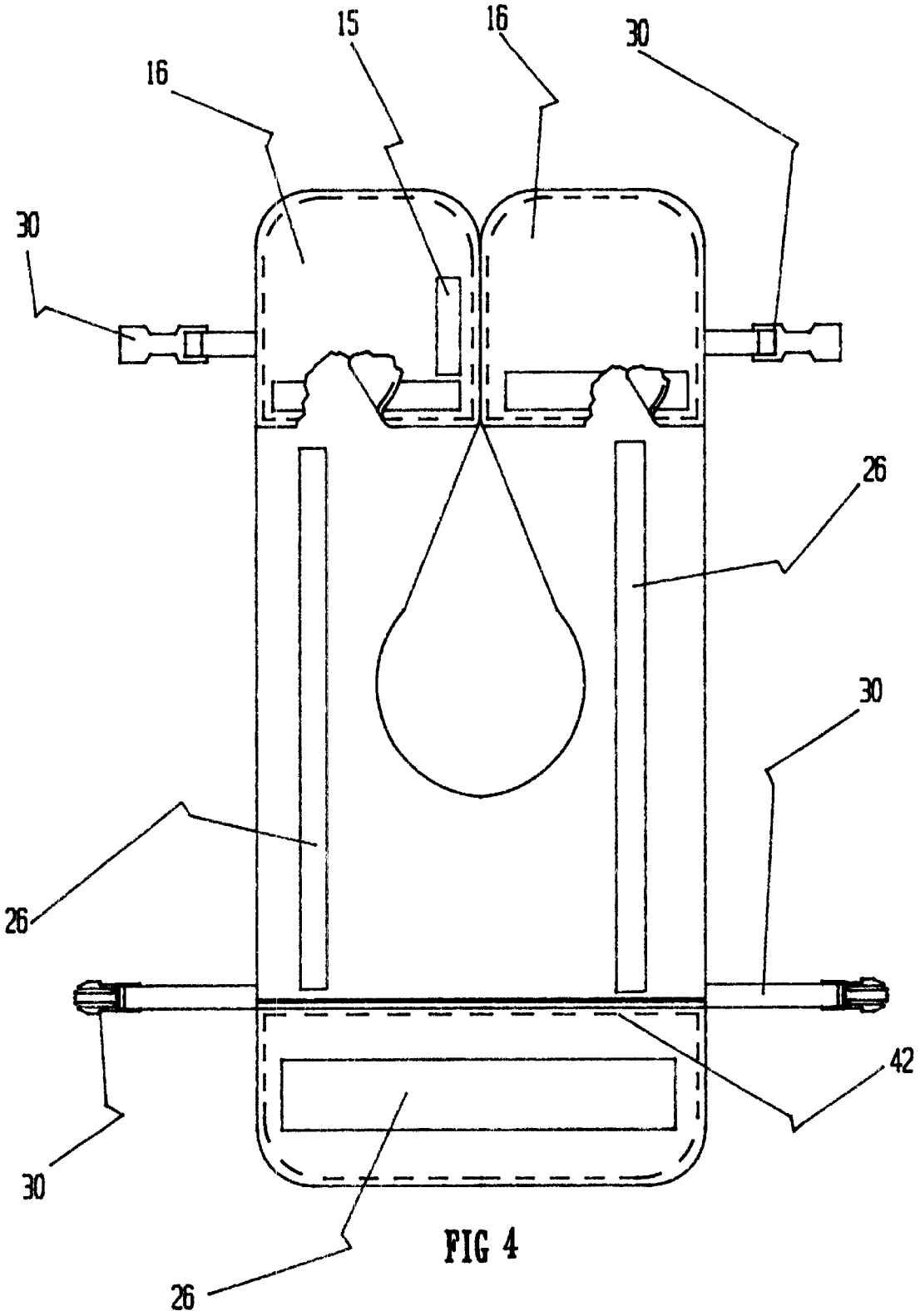
FIG. 4 is a perspective view of the exterior of the roadside emergency vest with a cut away view of the pockets.

FIG. 4 illustrates a rear view of the exterior of the roadside emergency vest 10. Illustrated is a cut away view of the pockets on the front panels 12, 14, the exterior of the lower back panel 28, and the exterior closure element 42 of the storage compartment 40.

Figure 5:
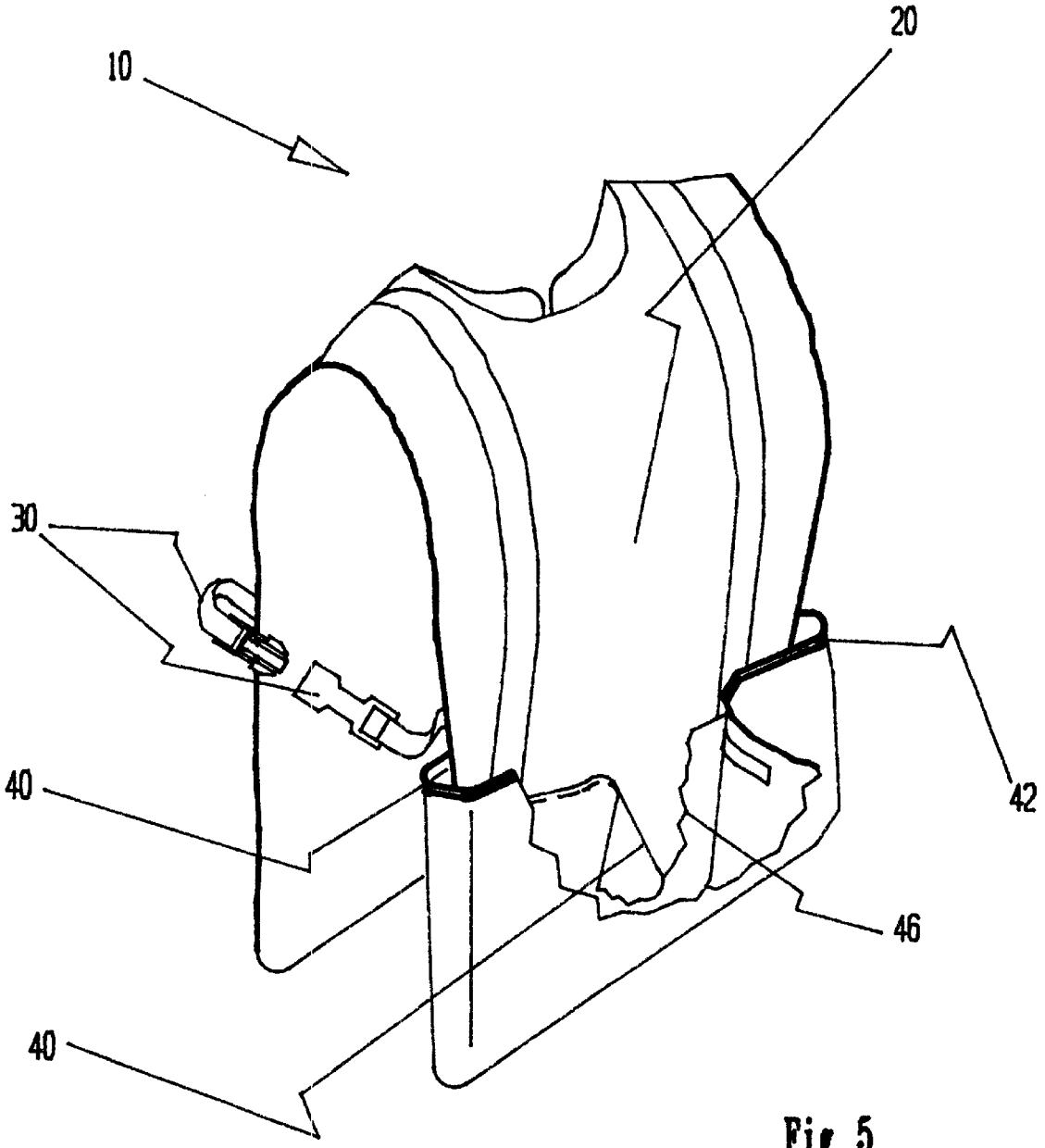
FIG. 5 is a rear view of the exterior of the roadside emergency vest wit a cut away view of the storage compartment including the separator flap.

FIG. 5 illustrates a rear view of the exterior of the roadside emergency vest 10. Illustrated is a cut away view of the interior of the storage compartment 40 showing exterior closure means 42 and the separator flap 46. The separator flap 46 provides additionally versatility to the storage compartment 40 by creating another separate storage area.

Figure 6:
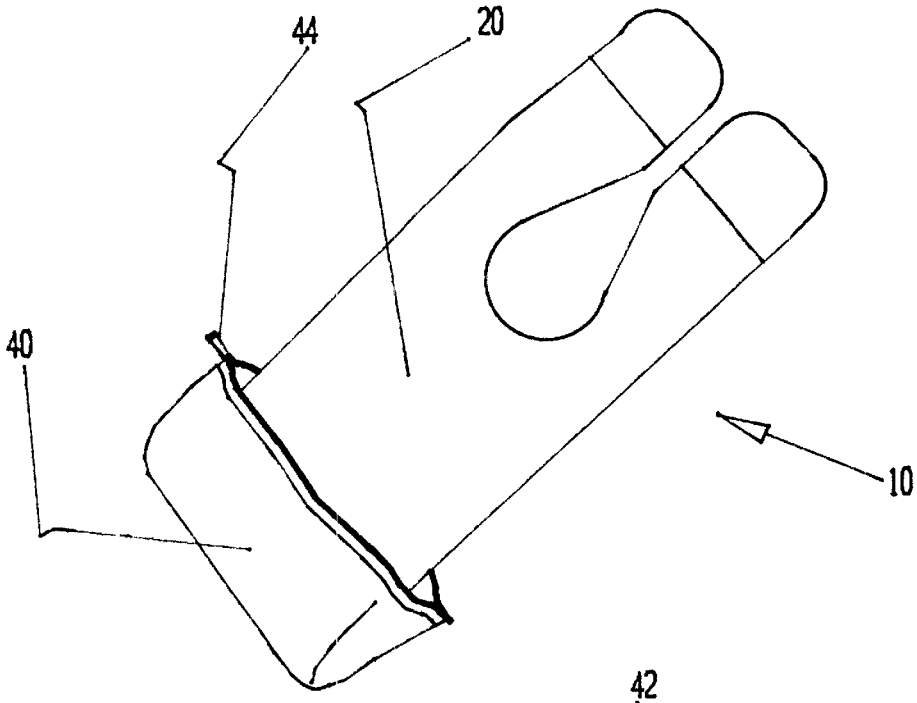
FIG. 6 is a view of the roadside emergency vest showing the vest being folded into the storage compartment.
Figure 7:
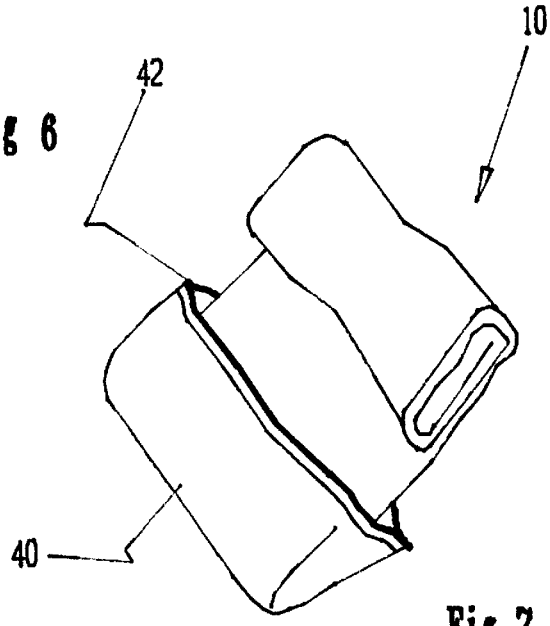
FIG. 7 is a view of the roadside emergency vest showing the vest being folded into the storage compartment

FIGS. 6 and 7 illustrate views of the roadside emergency vest 10 showing the vest being folded into the storage compartment 40.

Figure 8:
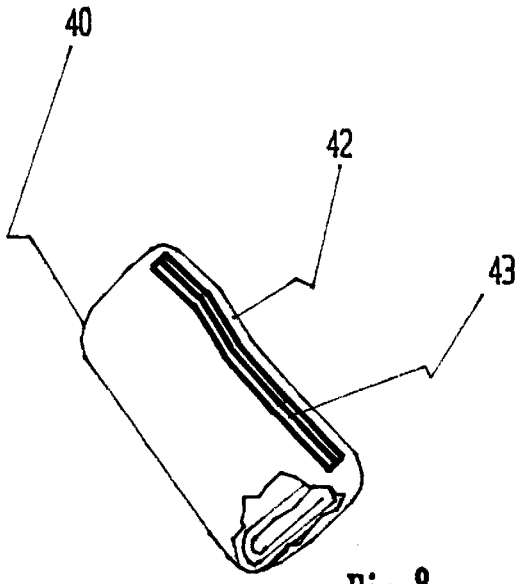
FIG. 8 is a view of the roadside emergency vest showing the vest completely folded into the storage compartment and the storage compartment zippered closed with a cut away view on one side.

FIG. 8 illustrates a view of the roadside emergency vest 10 completely folded into the storage compartment 40 and the storage compartment 40 zippered closed.

Changes and modifications in the specifically described embodiments can be carried out without departing from the scope of the invention which is intended to be limited only by the scope of the appended claims.

What is claimed:

1. A roadside emergency vest having rear, and left and right front portions that is convertible from a roadside emergency vest to a storage case, said vest comprising a neck opening, a waist opening, two arm openings, left and right breast panels forming the front portion, a back panel having an upper section and a lower section, an inside and an outside forming the rear portion, a front closure means for joining the left and right breast panels together at the front, a side closure means for joining the left and right breast panels with the back panel, a storage compartment located on the inside of the back panel lower section that is constructed integrally of material with back panel and having left and right side walls, a bottom wall, and a front wall, and a closure means at the top of storage compartment for closing the storage compartment, whereby:

i) when the vest is used as a vest, the left and right breast panels are joined to the back panel with the side closure means and the left and right breast panels are joined together with front closure means or are left open and ii) when the vest is converted into a storage case, the left and right breast panels and upper back section are stored in the storage compartment with emergency equipment.

2. The roadside emergency vest of claim 1 wherein the vest is illuminated by materials selected from the group consisting of reflective materials and strobe lights placed on front and rear portions of the vest.

3. The roadside emergency vest of claim 2 wherein the vest is illuminated with reflective materials.

4. The roadside emergency vest of claim 1 wherein the garment has one or more pockets on the left and right breast panels constructed to receive automobile emergency equipment.

5. The roadside emergency vest of claim 4 wherein the pockets on the left and right breast panels have closure means thereon.

6. The roadside emergency vest of claim 4 wherein the pockets on the left and right breast panel are detachably connected.

7. The roadside emergency vest claim of 1 wherein the inside back panel has pockets on the upper and lower sections which are optionally detachable.

8. The roadside emergency vest of claim 1 wherein the storage compartment has an interior flap which serves as a divider means.

9. The roadside emergency vest of claim 1 wherein the side closure means for joining the left and right breast panels to the back panel is selected from the group consisting of a zipper, ties, buttons, straps, belts, snaps, hooks, ladder locks and buckles.

10. The roadside emergency vest of claim 1 wherein the emergency equipment is selected from the group consisting of flashlight, first aid kit, flares, gloves, cellular phone, screwdrivers, wrenches, tire gauges, tire inflation products, strobe lights, siphon hoses, batteries and rain gear.

11. A roadside emergency kit that is a roadside emergency vest which converts to a storage case with emergency equipment stored therein and creating an integral part thereof comprising a convertible vest having a neck opening, a waist opening, two arm openings, left and right breast panels forming the front portion, a back panel having an upper section and a lower section, an inside and an outside forming the rear portion, a front closure means for joining the left and right breast panels together at the front, a side closure means for joining the left and right breast panels with the back panel, a storage compartment located on the inside of the back panel lower section that is constructed integrally of material with back panel and having left and right side walls, a bottom wall, and a front wall, and a closure means at the top of storage compartment for closing the storage compartment, whereby:

i) when the vest is used as a vest, the left and right breast panels are joined to the back panel with the side closure means and the left and right breast panels are joined together with front closure means or are left open and ii) when the vest is converted into a storage case, the left and right breast panels and upper back section are stored in the storage compartment; and Emergency equipment stored in the vest selected from the group consisting of flashlight, first aid kit, flares, gloves, cellular phone, screwdrivers, wrenches, tire gauges, tire inflation products, strobe lights, siphon hoses, batteries, jumper cables and rain gear.

12. The Roadside Assistance Kit of claim 11 wherein a plurality of pockets are strategically placed on the interior and exterior of the front and back of the subject vest sized to fit the emergency equipment that is stored therein.

13. The Roadside Assistance Kit of claim 12 wherein a plurality of pockets are strategically placed on the vest.

14. The Roadside Assistance Kit of claim 13 wherein the pockets have closure means thereon.

15. The Roadside Assistance Kit of claim 14 wherein the pockets closure means are secured by zipper, snaps, flaps, or buckles.

16. The roadside emergency vest of claim 13 wherein the pockets closure means are secured by zipper, snaps, flaps, or buckles.

17. The Roadside Assistance Kit of claim 13 wherein the pockets are detachably attached.

* * * * *